US005899967A

United States Patent [19]

Nagasaki

[11] Patent Number: 5,899,967

[45] Date of Patent: May 4, 1999

[54] SPEECH DECODING DEVICE TO UPDATE THE SYNTHESIS POSTFILTER AND PREFILTER DURING UNVOICED SPEECH OR NOISE

[75] Inventor: Mayumi Nagasaki, Tokyo, Japan

[73] Assignee: NEC Corporation, Tokyo, Japan

[21] Appl. No.: 08/823,580

[22] Filed: Mar. 25, 1997

[30] Foreign Application Priority Data

Mar. 27, 1996 [JP] Japan ..... 8-072089

[51] Int. Cl.[6] ..... G10L 5/00

[52] U.S. Cl. ..... 704/208; 704/222; 704/265

[58] Field of Search ..... 704/222, 223, 704/208, 214, 228, 258, 265, 210, 215, 200, 201

[56] References Cited

U.S. PATENT DOCUMENTS

| | | | |
|---|---|---|---|
| 4,672,670 | 6/1987 | Wang et al. | 704/217 |
| 5,233,660 | 8/1993 | Chen | 704/228 |
| 5,732,389 | 3/1998 | Kroon et al. | 704/223 |
| 5,752,222 | 5/1998 | Nishiguchi et al. | 704/201 |

FOREIGN PATENT DOCUMENTS 5-122165 5/1993 Japan .

*Primary Examiner*—David R. Hudspeth
*Assistant Examiner*—Donald L. Storm
*Attorney, Agent, or Firm*—Sughrue, Mion, Zinn, Macpeak & Seas, PLLC

[57] ABSTRACT

In the disclosed speech decoding device, activation of a postfilter process is halted during unvoiced sections. However, the updating process of the internal states of the postfilter continues even though the postfilter process is not activated during unvoiced sections. At changes between voiced and unvoiced sections, output signals outputted during voiced sections that have been subjected to a postfilter process and output signals outputted during unvoiced sections that have not been subjected to a postfilter process are interpolated and outputted. In one embodiment, a prefilter controller activates a prefilter state updater for unvoiced sections to update the internal state of the filter of a prefilter section based on excited signals to decrease any perception of noncontinuity in an output signal switching between activation and deactivation of the prefilter when changing between voiced and unvoiced sections.

4 Claims, 6 Drawing Sheets

SPEECH DECODING DEVICE TO UPDATE THE SYNTHESIS POSTFILTER AND PREFILTER DURING UNVOICED SPEECH OR NOISE

BACKGROUND OF THE INVENTION

1. Field of the Invention

The present invention relates to a speech decoding device, and particularly to a speech decoding device that can reduce power consumption when generating background noise of unvoiced sections in which speech code is not present.

2. Description of the Related Art

In speech coding devices, the transmission of speech coded information is halted when speech signals to be encoded are not present as a means of reducing power consumption. In such cases, there occurs a conspicuous degree of noncontinuity between voiced and unvoiced portions in the decoded speech signals decoded in speech decoding devices on the receiving side, and in order to solve this problem, background noise signals are artificially generated and outputted.

The configuration and operation of a background noise generation method of a speech decoding device of the prior art is described in detail in, for example, Japanese Patent Laid-open No. 122165/93.

In addition, details regarding encoding processes and decoding processes of speech signals in speech coding devices and speech decoding devices of the prior art are provided in, for example, Chapter 5.2.1 (Speech Coding Processing) and Chapter 5.2.4 (Speech Decoding Processing) of the Digital Automobile Telephone System Standards RCR STD-27C, Volume I (Research & Development Center for Radio Systems, Nov. 10, 1994).

Here, a brief explanation will be presented of the configuration of the background noise generation system of a prior-art speech decoding device with reference to FIG. 1.

FIG. 1 is a block diagram showing the configuration of a background noise generation system of the prior art. Referring to the figure, the prior-art background noise generation system is composed of input terminal 51 for inputting received information, received information memory 52 for storing received information, code generator 53 for generating code used in the decoding process, decode processor 54 for decoding code, and output terminal 55 for outputting output signals.

Sections, in which speech signals to be coded on the transmission side are present, are hereinbelow referred to as "voiced," and sections, in which speech signals to be coded are not present, are referred to as "unvoiced." In addition, code in which speech signals have been encoded on the encoding side is referred to simply as "code."

Received information memory 52 is provided with received code storage section 521 and voiced/unvoiced information storage section 522. Received code storage section 521 inputs received code from input terminal 51 and stores the code. Voiced/unvoiced information storage section 522 inputs information indicating whether the current section is voiced or unvoiced (hereinbelow referred to as "voiced/unvoiced information") and stores the information.

Code generator 53 is provided with background noise code generator 531, code controller c531, and code switch s531. Based on voiced/unvoiced information inputted from voiced/unvoiced information storage section 522, code controller c531 controls the operation of background noise code generator 531 and code switch s531 as follows:

During a voiced section, received code stored in received code storage section 521 is outputted, without change, to decoding processor 54. During an unvoiced section, background noise code generator 531 is activated, whereby code for background noise generation is generated from the code inputted from received code storage section 521, and is outputted to decoding processor 54.

Decoding processor 54 is provided with excited signal generator 541, synthesized signal generator 542, and postfilter section 543.

Code inputted from code generator 53 is transferred to excited signal generator 541, synthesized signal generator 542, and postfilter section 543.

Excited signal generator 541 generates and outputs excited signals from code inputted from code generator 53.

Synthesized signal generator 542 passes the inputted excited signals through a synthesizing filter to generate and output synthesized signals.

Postfilter section 543 passes synthesized signals generated at synthesized signal generator 542 through a postfilter to generate postfilter output signals, and outputs the signals from output terminal 55.

The postfilter section suppresses noise contained in the synthesized speech signals, and has the effect of improving the subjective quality of speech signals in voiced sections.

Next, referring to FIGS. 1 and 2, an explanation will be given regarding the operation of the background noise generation system of a prior-art speech decoding device.

Received code inputted from input terminal 51 is stored in received code storage section 521. In concrete terms, code is stored that indicates, for example, speech spectral envelope information, speech signal level, pitch information, and noise information. Voiced/unvoiced information inputted from input terminal 51 is stored in voiced/unvoiced information storage section 522.

Based on voiced/unvoiced information inputted from voiced/unvoiced information storage section 522, code controller c531 controls the operation of background noise code generator 531 and code switch s531 as follows (Step B1):

During a voiced section, received code stored in received code storage section 521 is outputted without alteration to decoding processor 54, and in addition, the received code is also outputted to background noise code generator 531. This process is executed because background noise code generator 531 generates code for background noise generation based on received code during voiced sections. The received code is actually code indicating, for example, speech spectral envelope information, speech signal level, pitch information, and noise information.

During an unvoiced section, code controller c531 activates background noise code generator 531. Background noise code generator 531 generates code for background noise generation from the most recently received code of the received code inputted from received code storage section 521, and outputs to decoding processor 54 (Step B2). The actual methods employed to generate code for background noise generation include, for example, level attenuation of speech signals and randomization of noise information.

Of the code inputted from code generator 53, excited signal generator 541 generates excited signals from code indicating, for example, pitch information and noise information, and outputs the result (Step B3).

One example of a method actually employed for the generation of excited signals can be described as follows: Excited signal generator 541 holds, in advance, pitch component signals and noise component signals as data bases for each of the codes indicating pitch information and noise information, and upon inputting code indicating pitch information and noise information from code generator 53, selects from each data base the pitch component signals and noise component signals that correspond to each code. The selected pitch component signals and noise component signals are added and excited signals are generated. For example, if the code indicating pitch information is L, the selected pitch component signal corresponding to code L is $b_L(n)$, the code representing noise information is I, and the selected noise component signal corresponding to code I is $u_I(n)$, the excited signal ex(n) can be calculated according to the following equation:

$$ex(n)=b_L(n)+u_I(n) \tag{1}$$

Of the code inputted from code generator 53, synthesized signal generator 542 forms a synthesizing filter from code indicating spectral envelope information. Synthesized signals are generated and outputted by passing excited signals inputted from excited signal generator 541 through the synthesizing filter (Step B4). An actual example of a synthesizing filter generation method employed can be explained as follows. If linear predictive code indicating spectral envelope is represented by $\alpha_i$, the transfer function A(z) of the synthesizing filter in synthesized signal generator 542 can be represented by the following equation:

$$A(z) = \frac{1}{1 - \sum_{i=1}^{N_P} \alpha_i \cdot z^{-i}} \tag{2}$$

However, $N_P$ is a degree (for example, the tenth degree) of linear predictive code $\alpha_i$.

Of the code inputted from code generator 53, postfilter section 543 forms a postfilter from code indicating spectral envelope information of speech signals and pitch information, and generates postfilter output signals by passing synthesized signals outputted from synthesized signals generator 542 through the postfilter, and outputs the signals from output terminal 55 (Step B5).

An actual example of a postfilter generation method can be described as follows. One proposed form of the construction of a postfilter for improving subjective quality of synthesized speech signals in a voiced section is a connection in series of a pitch enhancement filter that enhances the pitch component of synthesized speech signals, a high-frequency enhancement filter that enhances the high-frequency component, and a spectral shaping filter that enhances the spectral envelope.

As an example of the transfer function P(z) of a pitch enhancement filter that enhances the pitch component, the following equation can be proposed:

$$P(z) = \frac{1}{1 + g_c \cdot z^{-lag}} \tag{3}$$

Here, "lag" is the pitch cycle value of excited signals (for example, 20~146). Constant $g_c$ is a weighting coefficient (for example, 0.7).

As an example of the transfer function B(z) of a high-frequency enhancement filter that enhances the high-frequency component, the following equation can be proposed:

$$B(z)=1-g_b \cdot z^{-1} \tag{4}$$

Here, constant $g_b$ is a weighting coefficient (for example 0.4).

The following equation gives one possible form for a transfer function H(z) of the spectral shaping filter that enhances the spectral envelope:

$$H(z) = \frac{1 + \sum_{i=1}^{N_P} g_n{}^i \alpha(i) \cdot z^{-i}}{1 + \sum_{i=1}^{N_P} g_d{}^i \alpha(i) \cdot z^{-i}} \tag{5}$$

Here, $N_P$ is a degree of linear predictive parameter $\alpha$ (for example, the tenth degree). In addition, constants $g_n{}^i$ and $g_d{}^i$ are weighting coefficients (for example, $g_n{}^i$=0.5 and $g_d{}^i$=0.8).

However, the above-described speech decoding device of the prior art has the following problems:

If postfilter processing is incorporated into the speech decoding process, the filtering process of the postfilter requires a massive number of sum-of-product calculations, and this results in increased power consumption.

If, on the other hand, the postfilter is not activated during unvoiced sections as a means of reducing power consumption, the internal state of the postfilter is not updated during intervals when operation of the postfilter is halted, with the consequent drawback of degradation of synthesized speech signals for a voiced section that immediately follows the change from an unvoiced to voiced section. Moreover, there is the additional problem that perception of noncontinuity occurs in reproduced signals between voiced and unvoiced sections due to switching between activation and deactivation of the postfilter upon changes between voiced and unvoiced sections.

SUMMARY OF THE INVENTION

The speech decoding device relating to the present invention is provided with a background noise generation system that solves the above-described problems of the prior art, reduces the power consumption during unvoiced sections, and moreover, produces no perception of noncontinuity or degradation of the quality of synthesized speech signals when changing between unvoiced and voiced sections.

In a speech decoding device that inputs both speech signals that are encoded to code including spectral envelope information of speech, sound level, pitch information, and noise information; and information that distinguishes between voiced sections in which speech signals are present and unvoiced sections in which speech signals are absent; that decodes and outputs inputted speech signals during voiced sections; and that decodes and outputs background noise signals during unvoiced sections that are generated and encoded based on speech signals inputted during an immediately preceding voiced section; the present invention is characterized in having the following constituent elements:

(1) Synthesized signal generating means that excites pitch information and noise information included in the speech signals and background noise signals, and generates synthesized signals based on these excited signals and speech spectral envelope information contained within the speech signals and background noise signals;

(2) Postfilter means that forms a postfilter based on speech spectral envelope information and pitch information contained within the speech signals and background noise signals, inputs synthesized signals generated by the synthesized signal generating means, performs filter processing, and outputs a result;

(3) Postfilter state updating means that passes synthesized signals generated by the synthesized signal generating means and updates the internal state of the postfilter based on the passed synthesized signal information; and (4) Connection of the synthesized signal generating means to the postfilter means and output of synthesized signals by way of the postfilter in voiced sections; and connection of the synthesized signal generating means to the postfilter state updating means and output of synthesized signals by way of the postfilter state updating means in unvoiced sections.

In addition, this speech decoding device is additionally provided with an output signal interpolating means that inputs and stores both the signals outputted by the postfilter means and signals that have passed through the postfilter state updating means and outputs signals synthesized from the two signals; and outputs synthesized signals outputted by this output signal interpolating means upon changes between voiced sections and unvoiced sections.

The present invention is moreover a speech decoding device that includes the following constituent elements:

(1) Signal exciting means that excites and outputs pitch information and noise information contained within speech signals and background noise signals;

(2) Prefilter means that forms a prefilter based on pitch information contained within speech signals and background noise signals, inputs excited signals outputted by the signal exciting means, performs filter processing, and outputs the result;

(3) Prefilter state updating means that passes excited signals outputted by the signal exciting means and updates the internal state of the prefilter based on the passed excited signal information;

(4) Synthesized signal generating means that is connected to the prefilter means and the prefilter state updating means and that generates synthesized signals based on inputted signals and speech spectral envelope information contained within speech signals and background noise signals;

(5) Postfilter means that forms a postfilter based on speech spectral envelope information and pitch information contained within speech signals and background noise signals, inputs synthesized signals generated by the synthesized signal generating means, performs filter processing, and outputs the result;

(6) Postfilter state updating means that passes synthesized signals generated by the synthesized signal generating means and updates the internal state of the postfilter based on the passed synthesized signal information;

(7) During voiced sections, input of signals outputted by the signal exciting means to the synthesized signal generating means by way of the prefilter means, and moreover, connection of the synthesized signal generating means to the postfilter means and output of synthesized signals by way of the postfilter; and (8) During unvoiced sections, input of signals outputted by the signal exciting means to the synthesized signal generating means by way of the prefilter state updating means, and moreover, connection of the synthesized signal generating means to the postfilter state updating means and output of synthesized signals by way of the postfilter state updating means.

In addition, this speech decoding device is further provided with an output signal interpolating means which inputs and stores both signals outputted by the postfilter means and signals that have passed through the postfilter state updating means, and which outputs synthesized signals of the two types of signals; and outputs synthesized signals that are outputted by this output signal interpolating means upon changes between voiced sections and unvoiced sections.

The above and other objects, features, and advantages of the present invention will become apparent from the following description based on the accompanying drawings which illustrate examples of preferred embodiments of the present invention.

DETAILED DESCRIPTION OF THE PREFERRED EMBODIMENTS

Figure 3:
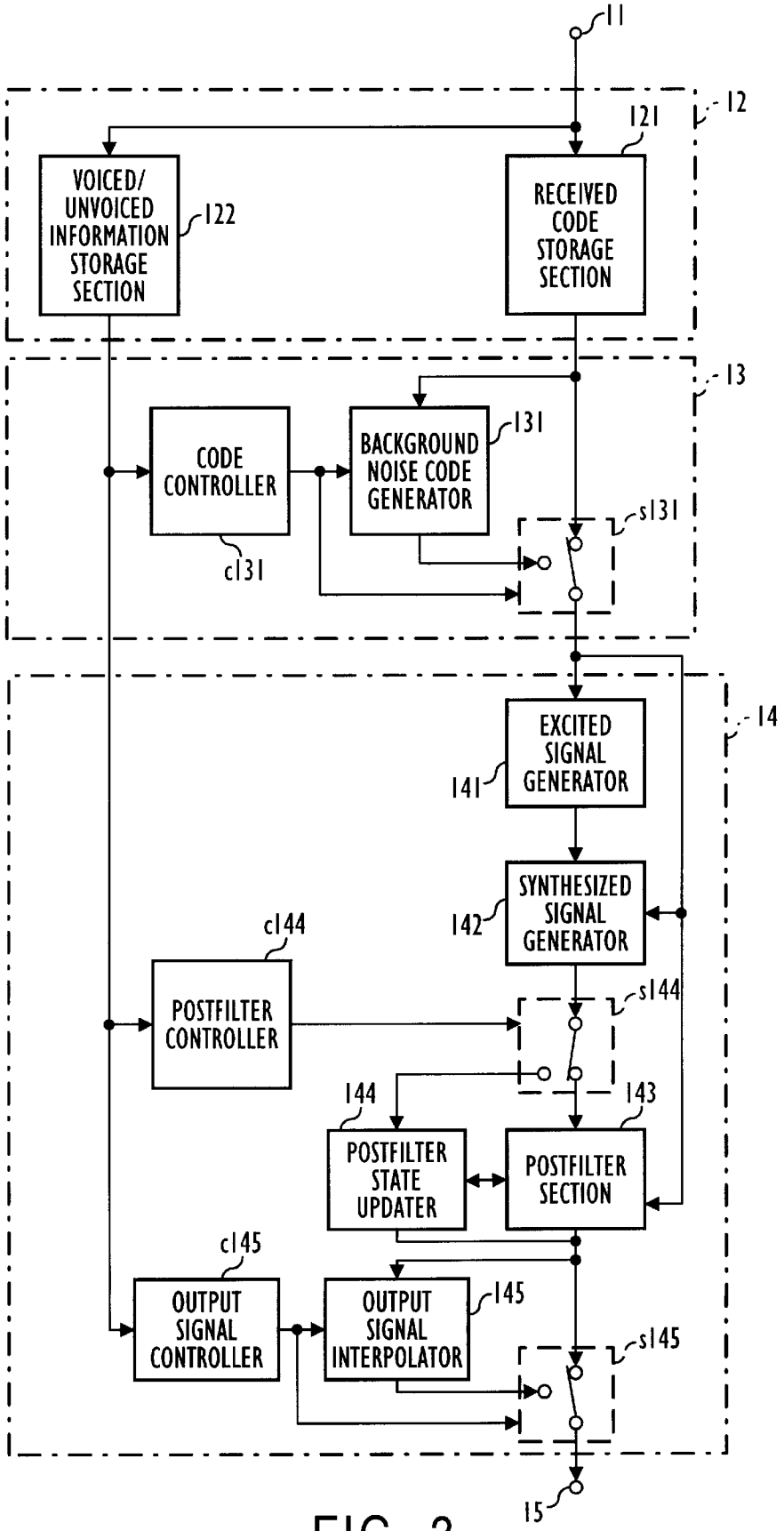
FIG. 3 is a block diagram showing the configuration of the first embodiment of the background noise generating system of speech decoding device according to the present invention.

FIG. 3 is a block diagram showing the configuration of the first embodiment of the background noise generating system of a speech decoding device according to the present invention. Details regarding the configuration of the first embodiment of the background noise generating system of the speech decoding device of the present invention will next be given with reference to FIG. 3.

Referring to FIG. 3, the first embodiment of the background noise generating system of the speech decoding device of the present invention includes input terminal 11 for inputting received information, received information memory 12 for storing received information, code generator 13 for generating code used in the decoding process, decoding processor 14 for decoding code, and output terminal 15 for outputting output signals.

Received information memory 12 is provided with received code storage section 121 and voiced/unvoiced information storage section 122. Received code storage section 121 inputs and stores received code from input terminal 11. Voiced/unvoiced information storage section 122 inputs and stores voiced/unvoiced information from input terminal 11. The configuration of received information memory 12, received code storage section 121, and voiced/unvoiced information storage section 122 is identical to the configuration of the prior-art received information memory 52, received code storage section 521, and voiced/unvoiced information storage section 522 shown in FIG. 1.

Code generator 13 is provided with background noise code generator 131, code controller c131, and code switch s131. Based on voiced/unvoiced information inputted from voiced/unvoiced information storage section 122, code controller c131 controls the operation of background noise code generator 131 and code switch s131 as follows:

During voiced sections, received code stored in received code storage section 121 is outputted to decoding processor 14 without alteration. During unvoiced sections, background noise code generator 131 is activated, code for background noise generation is generated from the code inputted from received code storage section 121, and this code is outputted to decoding processor 14.

Figure 1:
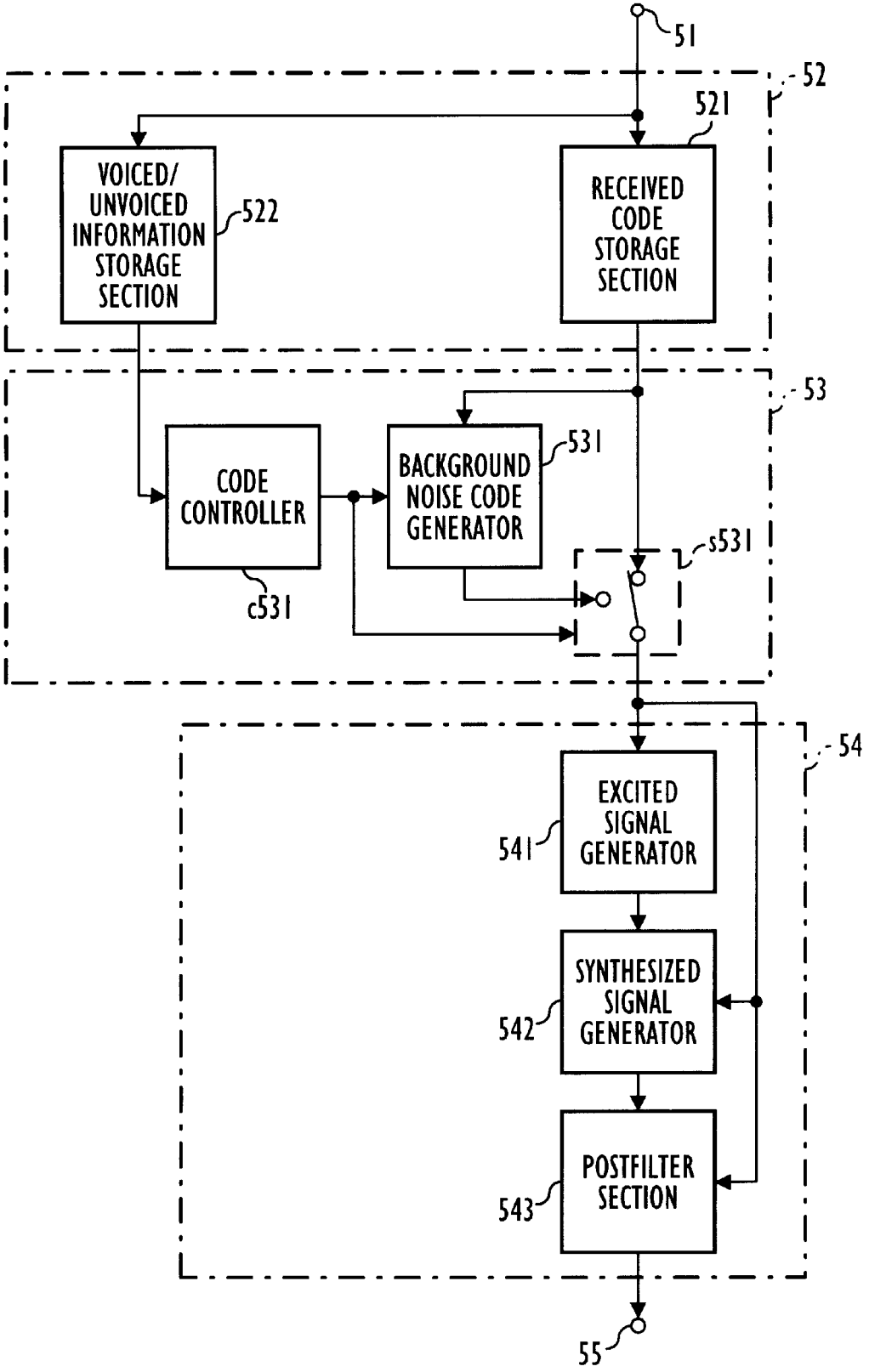
FIG. 1 (PRIOR ART)
FIG. 1 is a block diagram showing the configuration of a background noise generating system of a speech decoding device of the prior art.

The configurations of code generator 13, background noise code generator 131, code controller c131, and code switch s131 are identical to the configurations of prior-art code generator 53, background noise code generator 531, code controller c531, and code switch s531 shown in FIG. 1.

Decoding processor 14 is provided with excited signal generator 141, synthesized signal generator 142, postfilter section 143, postfilter state updater 144, postfilter controller c144, postfilter switch s144, output signal interpolator 145, output signal controller c145, and output signal switch s145.

Code inputted from code generator 13 is transferred to excited signal generator 141, synthesized signal generator 142, and postfilter section 143.

Excited signal generator 141 generates and outputs excited signals from code inputted from code generator 13. The configuration of excited signal generator 141 is identical to the configuration of prior-art excited signal generator 541 shown in FIG. 1.

Synthesized signal generator 142 passes inputted excited signals through a synthesizing filter, generates synthesized signals, and outputs the result. The configuration of synthesized signal generator 142 is identical to the configuration of prior-art synthesized signal generator 542 shown in FIG. 1.

Postfilter controller c144 controls the operation of postfilter section 143, postfilter state updater 144 and postfilter switch s148 according to the voiced/unvoiced information stored in voiced/unvoiced information storage section 122.

During voiced sections, postfilter controller c144 activates postfilter section 143. Postfilter section 143 passes synthesized signals generated at synthesized signal generator 142 through a postfilter to generate postfilter output signals and outputs the result. The configuration of postfilter section 143 is identical to the configuration of prior-art postfilter section 543 shown in FIG. 1.

During unvoiced sections, postfilter controller c144 activates postfilter state updater 144. Postfilter state updater 144 outputs without alteration background noise signals which are synthesized signals outputted from synthesized signal generator 142 during unvoiced sections, and simultaneously updates the internal state of the filter of postfilter section 143 according to the background noise signals. This process is executed to reduce any perception of noncontinuity in output signals at the time of switching between activation and deactivation of the postfilter at changes between voiced and unvoiced sections.

Output signal controller c145 controls the operation of output signal interpolator 145 and output signal switch s145 in accordance with voiced/unvoiced information stored in voiced/unvoiced information storage section 122.

During voiced sections, speech signals outputted from postfilter section 143 are outputted from output terminal 15, and the speech signals are also simultaneously outputted to output signal interpolator 145. During unvoiced sections, background noise signals outputted from postfilter state updater 144 are outputted from output terminal 15, and the background noise signals are also simultaneously outputted to output signal interpolator 145.

At changes between voiced and unvoiced sections, output signal controller c145 interpolates signals outputted from postfilter section 143 and postfilter state updater 144. This process is executed to eliminate any perception of noncontinuity in the output signals upon switching between activation and deactivation of the postfilter at changes between voiced and unvoiced sections.

Figure 4:
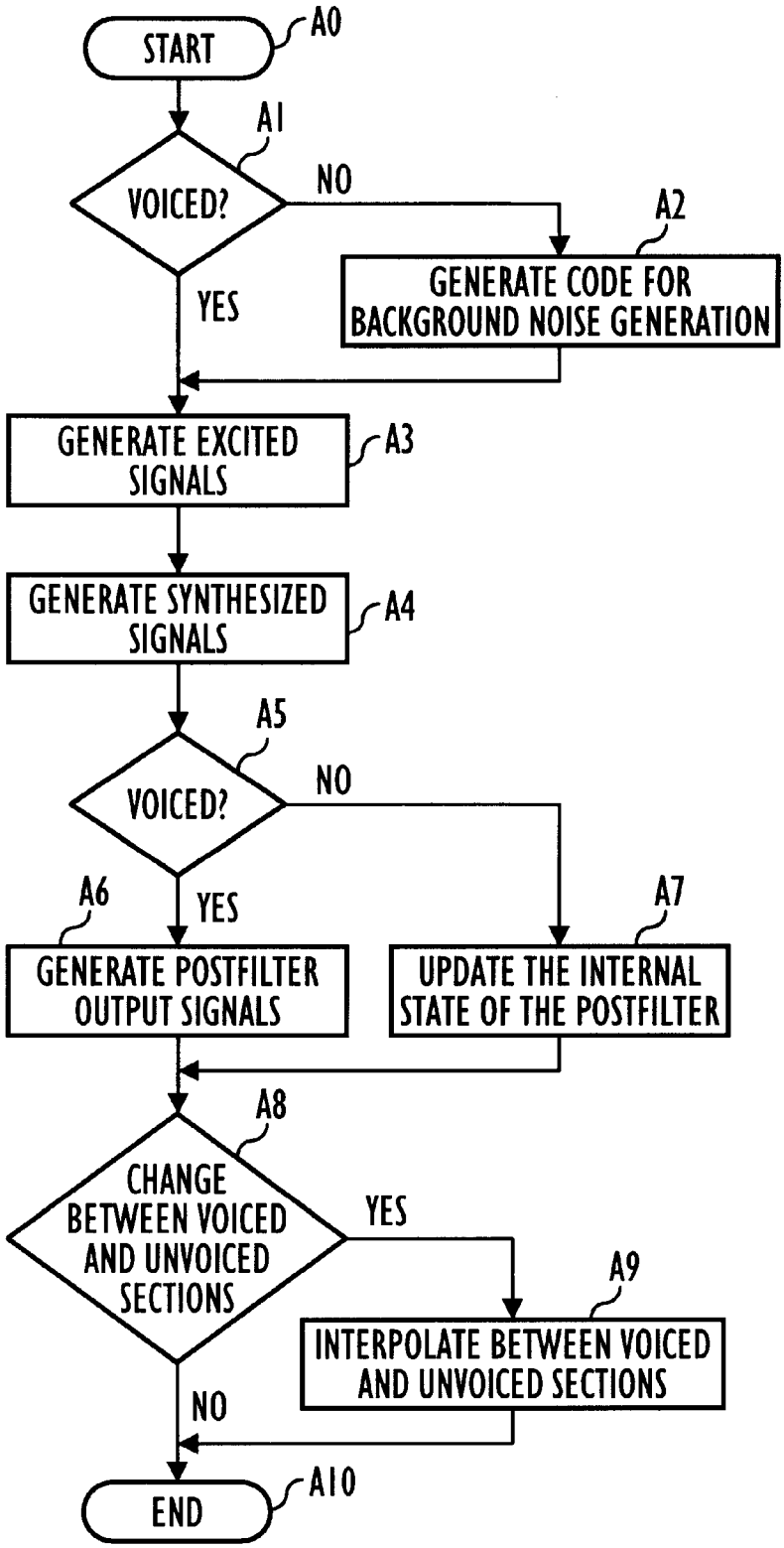
FIG. 4 is a flow chart illustrating the operation of the first embodiment of the background noise generating system of a speech decoding device according to the present invention.

Next, explanation will be presented with reference to FIG. 3 and FIG. 4 regarding the operation of the first embodiment of the background noise generating system of the speech decoding device of the present invention.

Received code inputted from input terminal 11 is stored in received code storage section 121. In concrete terms, code is stored that indicates, for example, spectral envelope information of speech, speech signal level, pitch information, and noise information. The voiced/unvoiced information inputted from input terminal 11 is stored in voiced/unvoiced information storage section 122.

Figure 2:
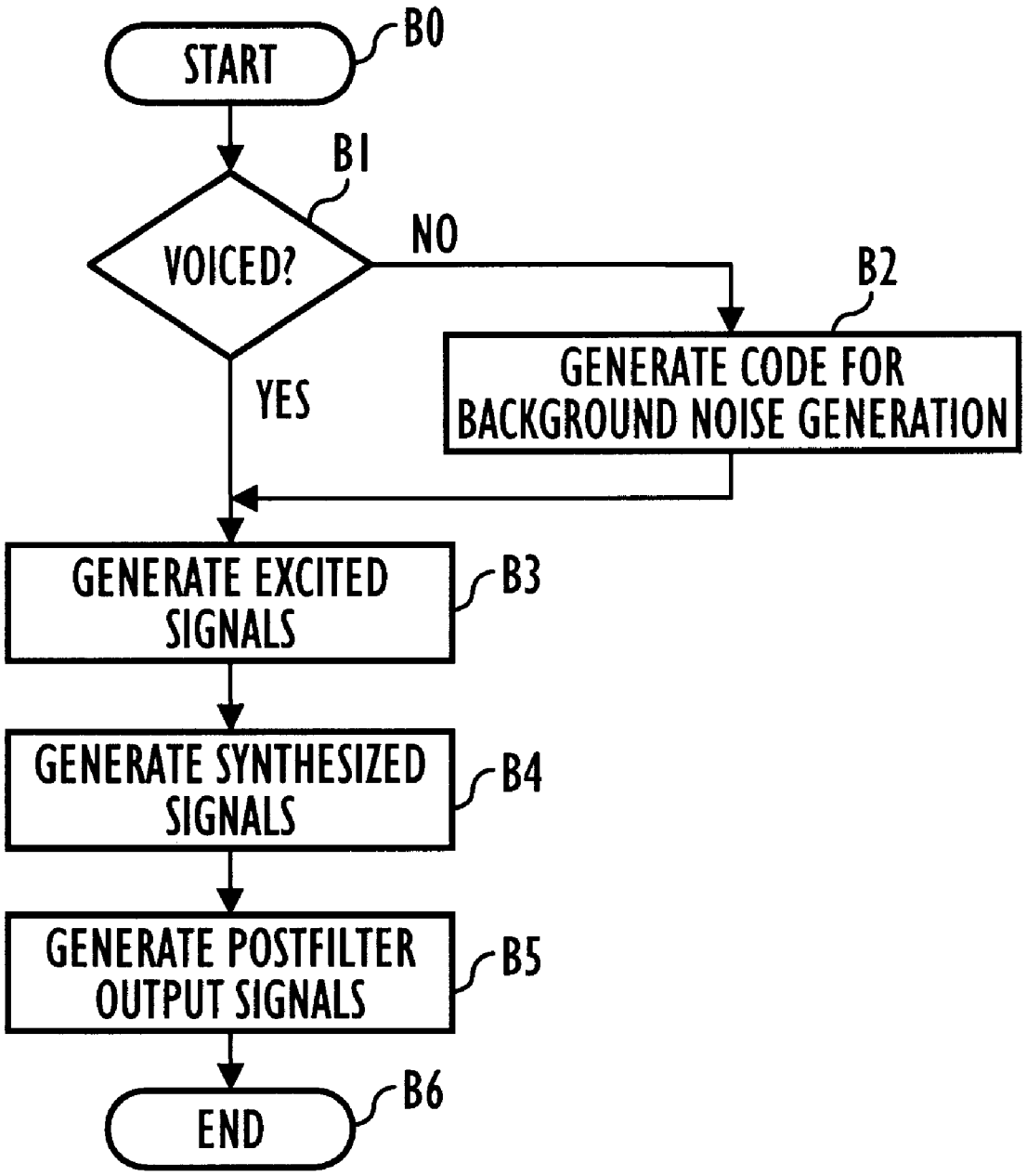
FIG. 2 (PRIOR ART)
FIG. 2 is a flow chart illustrating the operation of the background noise generating system of a speech decoding device of the prior art.

Based on voiced/unvoiced information inputted from voiced/unvoiced information storage section 122, code controller c131 controls the operation of background noise code generator 131 and code switch s131 as explained hereinbelow (Step A1). The operation of Step A1 is identical to the operation of Step B1 of the prior-art example shown in FIG. 2.

During voiced sections, received code stored in received code storage section 121 is outputted without alteration to decoding processor 14, and in addition, the received code is outputted to background noise code generator 131. This process is executed in order that, when background noise code generator 131 generates code for background noise generation, it will generate code for background noise generation based on received code during voiced sections. In concrete terms, the received code is code indicating, for example, speech spectral envelope information, speech signal level, pitch information, and noise information.

During unvoiced sections, code controller c131 activates background noise code generator 131. Background noise code generator 131 generates code for background noise generation from the most recently received code of the past received code inputted from received code storage section 121 and outputs the code to decoding processor 14. Actual examples of methods used to generate code for background noise generation from received code include attenuation of speech signal level and randomization of noise information (Step A2). The operation of Step A2 is identical to the operation of Step B2 of the prior-art example shown in FIG. 2.

Of the code inputted from code generator 13, excited signal generator 141 generates and outputs excited signals from parameters indicating pitch information and noise information (Step A3). The operation of Step A3 is identical to the operation of Step B3 of the prior-art example shown in FIG. 2. One actual example of a method for generating excited signals can be described as follows. Excited signal generator 141 holds in advance pitch component signals and noise component signals as data bases for each of the codes indicating pitch information and noise information. Excited signal generator 141 inputs code indicating pitch information and noise information from code generator 13 and then selects pitch component signals and noise component signals corresponding to each code from each data base, and adds the selected pitch component signals and noise component signals to generate excited signals. For example, if L is the code representing pitch information, $b_L(n)$ the selected pitch component signal corresponding to code L, I the code representing noise information, and $u_I(n)$ the selected noise component signal corresponding to code I, the excited signal ex(n) can be calculated as shown in the following equation.

$$ex(n)=b_L(n)+u_I(n) \tag{6}$$

Here, equation (6) is identical to equation (1) for calculating excited signals in the prior art.

Of the code inputted from code generator 13, synthesized signal generator 142 forms a synthesizing filter from code indicating spectral envelope information, passes excited signals inputted from excited signal generator 141 through the synthesizing filter to generate synthesized signals, and outputs the result (Step A4). The operation of Step A4 is identical to the operation of Step B4 of the prior-art example shown in FIG. 2.

A concrete example of the generation method of the synthesizing filter can be described as follows. If $\alpha_i$ represents the linear predictive code indicating spectral envelope, the transfer function A(z) of the synthesizing filter in synthesized signal generator 142 can be represented as shown in the following equation:

$$A(z) = \frac{1}{1 - \sum_{i=1}^{N_P} \alpha_i \cdot z^{-i}} \tag{7}$$

Here, $N_P$ is a degree of linear predictive code $\alpha_i$ (for example, the 10th degree). Equation (7) is identical to equation (2) used to calculate excited signals in the prior art.

Postfilter controller c144 controls the operations of postfilter section 143, postfilter state updater 144, and postfilter switch s144 from information stored in voiced/unvoiced information storage section 122 (Step A5).

During voiced sections, postfilter controller c144 activates postfilter section 143. Of the code inputted from code generator 13, postfilter section 143 forms a postfilter from code indicating the spectral envelope information and pitch information of speech signals, passes synthesized signals outputted from synthesized signal generator 142 through the postfilter to generate postfilter output signals, and outputs the result (Step A6). The operation of Step A6 is identical to the operation of Step B5 of the prior-art example shown in FIG. 2.

One concrete example of the generation method of the postfilter can be described as follows. One example of the configuration of a postfilter that can be adopted for improving the subjective quality of synthesized speech signals in voiced sections takes the form of a connection in series of a pitch enhancement filter that enhances the pitch component of synthesized speech signals, a high-frequency enhancement filter that enhances the high-frequency component, and a spectral shaping filter that enhances the spectral envelope.

The following equation is one example of the transfer function P(z) of a pitch enhancement filter that enhances the pitch component.

$$P(Z) = \frac{1}{1 + g_c \cdot Z^{-lag}} \tag{8}$$

Here, "lag" is the pitch cycle value of the excited signals (for example, 20~146). In addition, constant $g_c$ is a weighting coefficient (for example, 0.7).

Equation (8) is identical to equation (3) used for calculating excited signals in the prior-art example.

The following equation is one example of the transfer function B(z) of the high-frequency enhancement filter that enhances the high-frequency component.

$$B(z)=1-g_b \cdot z^{-1} \tag{9}$$

Here, constant $g_b$ is a weighting coefficient (for example, 0.4). Moreover, equation (9) is identical to equation (4) used to calculate excited signals in the prior-art example.

The following equation is one example of the transfer function H(z) of the spectral shaping filter that enhances the spectral envelope.

$$H(z) = \frac{1 + \sum_{i=1}^{N_P} g_n{}^i \alpha(i) \cdot z^{-i}}{1 + \sum_{i=1}^{N_P} g_d{}^i \alpha(i) \cdot z^{-i}} \tag{10}$$

Here, $N_P$ is a degree of linear predictive parameter $\alpha$ (for example, the 10th degree). In addition, constants $g_n{}^i$ and $g_d{}^i$ are weighting coefficients (for example, $g_n{}^i$=0.5 and $g_d{}^i$=0.8). Moreover, equation (10) is identical to equation (5) for calculating excited signals in the prior-art example.

During unvoiced sections, postfilter controller c144 activates postfilter state updater 144. Postfilter state updater 144 outputs background noise signals without alteration, i.e., the synthesized signals during unvoiced sections outputted from synthesized signal generator 142, and simultaneously updates the internal state of the filter of postfilter section 143 using the background noise signals. This process is executed in order to decrease any perception of noncontinuity in output signals upon switching between activation and deactivation of the postfilter at changes between voiced and unvoiced sections. In concrete terms, the filter states of each of the filters of the above-described transfer functions P(z), B(z), and H(z) are updated. Moreover, the operation of updating the filter states of each of the filters is equivalent to the operation of making the coefficient of each filter 0 and allowing passage through each filter (Step A7).

Output signal controller c145 controls the operation of output signal interpolator 145 and output signal switch s145 using voiced/unvoiced information stored in voiced/unvoiced information storage section 122 (Step A8).

During voiced sections, speech signals outputted from postfilter section 143 are outputted from output terminal 15, and simultaneously, the speech signals are outputted to output signal interpolator 145. During unvoiced sections, the background noise signals outputted from postfilter state updater 144 are simultaneously outputted from output terminal 15 and to output signal interpolator 145.

At changes between voiced and unvoiced sections, output signal controller c145 interpolates the output signals from postfilter section 143 and postfilter state updater 144. This process is executed in order to eliminate any perception of noncontinuity in output signal upon switching between activation and deactivation of the postfilter at changes between voiced and unvoiced sections (Step A9).

One concrete example of an interpolation method employed when changing from a voiced to an unvoiced section can be described as follows.

In this description, V(t) represents output signals from postfilter section 143 at time t; U(t) represents output signals from postfilter state updater 144 at time t; ST represents the time interpolation begins, i.e., the time of change from a voiced to an unvoiced section; ET represents the time interpolation ends; and O(t) represents final output signals to output terminal 15 during the time interval from time ST to time ET.

During the time up to time ST, i.e., the time of the voiced section, output signal controller c145 outputs from output terminal 15 the speech signals outputted from postfilter section 143 without change.

$$O(t)=V(t) \tag{11}$$

Here, $t \leqq ST$.

During the time after time ST and up to time ET, output signal interpolator 145 first passes output signals from synthesized signal generator 142 to postfilter section 143 and holds output signals V(t) from postfilter section 143. Output signal interpolator 145 next passes output signals from synthesized signal generator 142 to postfilter state updater 144 and holds output signals U(t) from postfilter state updater 144. Output signals O(t) are then calculated as shown in the following equation at time t.

$$O(t) = \frac{(ET-t)\cdot V(t)}{ET-ST} + \frac{(t-ST)\cdot U(t)}{ET-ST} \tag{12}$$

Here, $ST \leqq t = ET$.

After time ET, i.e., during the unvoiced section, output signal controller c145 outputs background noise signals U(i) outputted from postfilter state updater 144 without change from output terminal 15.

$$O(t)=U(t) \tag{13}$$

Here, $ET \leqq t$.

Explanation will next be presented regarding the second embodiment of the voice decoding device of the present invention.

Figure 5:
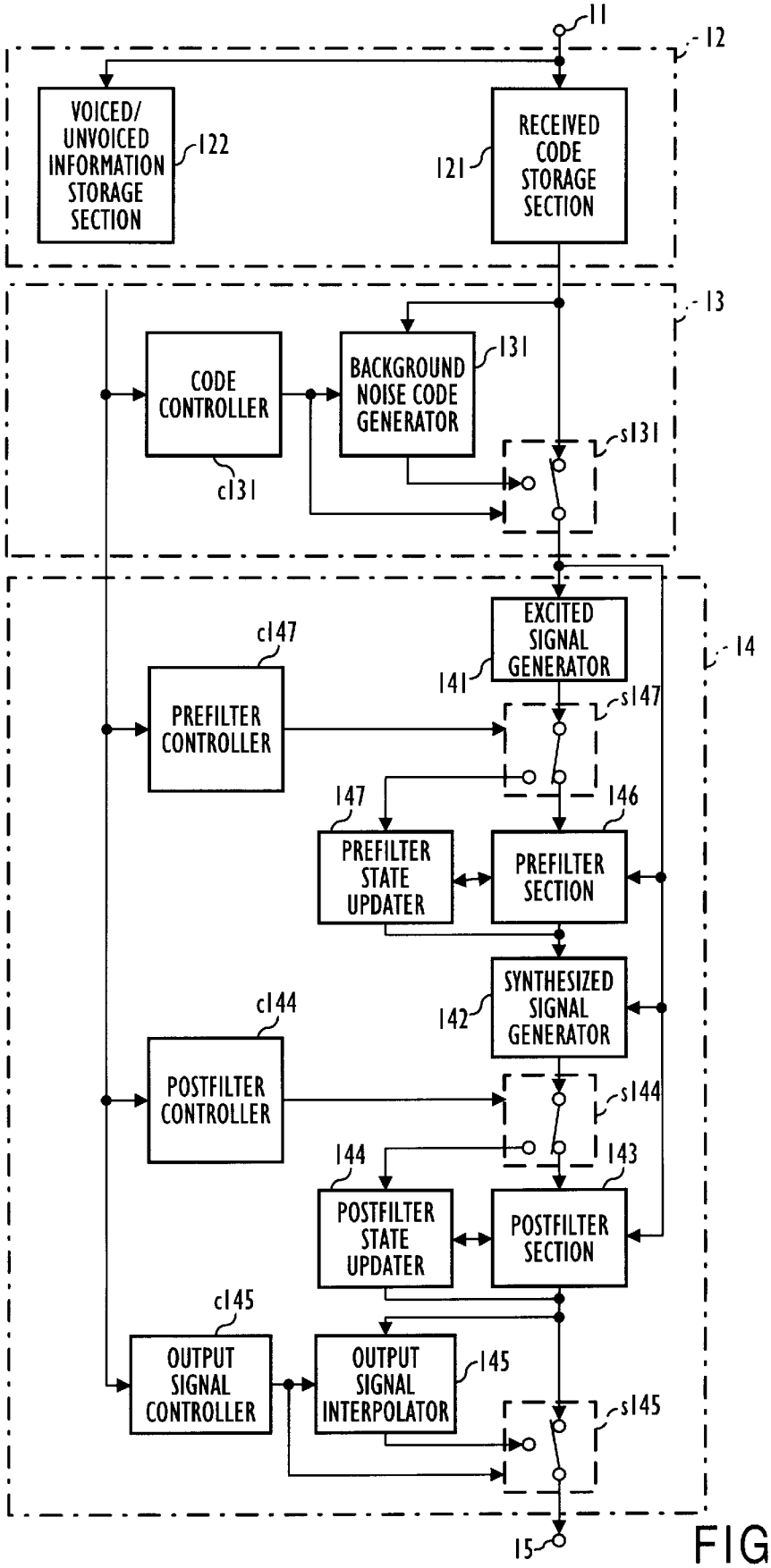
FIG. 5 is a block diagram showing the configuration of the second embodiment of the background noise generating system of a speech decoding device according to the present invention.

FIG. 5 is a block diagram showing the configuration of the second embodiment of a background noise generation system of a speech decoding device according to the present invention. An explanation of the configuration of the second embodiment of the background noise generation system of the speech decoding device of the present invention is presented hereinbelow with reference to FIG. 5.

Referring to FIG. 5, the configuration of decoding processor 14 in the configuration of the second embodiment of the background noise generation system of the speech decoding device of the present invention differs from that of decoding processor 14 in the first embodiment shown in FIG. 3 in that prefilter section 146, prefilter state updater 147, prefilter controller c147, and prefilter switch s147 are added between excited signal generator 141 and synthesized signal generator 142.

Prefilter controller c147 controls the operation of prefilter section 146, prefilter state updater 147, and prefilter switch s147 in accordance with voiced/unvoiced information stored in voiced/unvoiced information storage section 122.

During voiced sections, prefilter controller c147 activates prefilter section 146, and during unvoiced sections, prefilter controller c147 activates prefilter state updater 147.

The configuration of prefilter section 146 can be made identical to that of the pitch enhancement filter that enhances the pitch component, which is one of the configurations of postfilter section 143 in the first embodiment of the background noise generation system of the speech decoding device of the present invention.

Prefilter state updater 147 outputs excited signals outputted from excited signal generator 141 without alteration to synthesized signal generator 142 and simultaneously updates the internal state of the filter of prefilter section 146 in accordance with the excited signals.

The operation of the second embodiment of the background noise generation system of the speech decoding device of the present invention will next be described with reference to FIGS. 5 and 6.

Figure 6:
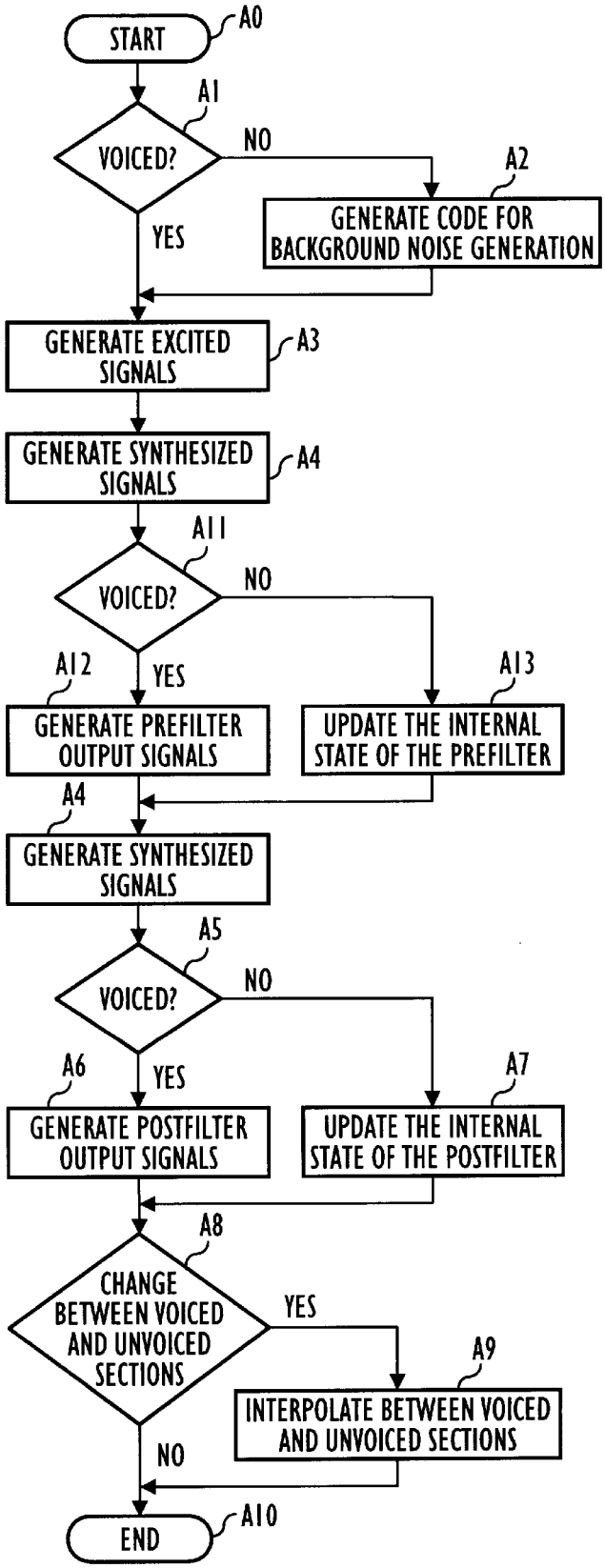
FIG. 6 is a flow chart illustrating the operation of the second embodiment of the background noise generating system of a speech decoding device according to the present invention.

The operation of received information memory 12, code generator 13, and excited signal generator 141 in the second embodiment as shown in Steps A1 to A3 in FIG. 6 is identical to that of the operation of received information memory 12, code generator 13, and excited signal generator 141 in the first embodiment, and explanation of this operation is therefore here omitted.

According to the first embodiment, excited signals outputted from excited signal generator 141 are inputted without change to synthesized signal generator 142, but in the second embodiment, the constituent elements of the pitch enhancement filter, which enhances the pitch component and which is one of the constituent elements of postfilter section 143 of the first embodiment, are arranged before the synthesizing filter, and excited signals outputted from excited signal generator 141 are therefore inputted to synthesized signal generator 142 after passage through either prefilter section 146 or prefilter state updater 147.

Prefilter controller c147 controls the operation of prefilter section 146, prefilter state updater 147, and prefilter switch s147 using the voiced/unvoiced information stored in voiced/unvoiced information storage section 122 (Step A11).

During voiced sections, prefilter controller c147 activates prefilter section 146. Of the code inputted from code generator 13, prefilter section 146 forms a prefilter from the code indicating pitch information of speech signals, passes excited signals outputted from excited signal generator 141 through the prefilter to generate prefilter output signals, and outputs the result (Step A12).

The transfer function P(z) of the pitch enhancement filter makes up one constituent of the configuration of the postfilter in the first embodiment can be proposed as one example of the actual prefilter generation method employed in the second embodiment, and explanation is therefore here omitted.

During unvoiced sections, prefilter controller c147 activates prefilter state updater 147. Prefilter state updater 147 outputs excited signals outputted from excited signal generator 141 without alteration and simultaneously updates the internal state of the filter of prefilter section 146 according to the excited signals. This process is executed in order to decrease any perception of noncontinuity in the output signals at switching between activation and deactivation of the prefilter at changes between voiced and unvoiced sections. In concrete terms, this means updating the filter state, i.e., the transfer function P(z) of the prefilter (Step A13).

The operation of the synthesized signal generator 142 of the second embodiment shown by Step A4 in FIG. 6 can be identical to the operation of the synthesized signal generator 142 in the first embodiment, and explanation is therefore here omitted.

Postfilter controller c144 controls the operation of postfilter section 143, postfilter state updater 144, and postfilter switch s144 with the information stored in voiced/unvoiced information storage section 122 (Step A5).

During voiced sections, postfilter controller c144 activates postfilter section 143. Of the code inputted from code generator 13, postfilter section 143 forms a postfilter from code representing the spectral envelope of speech signals and pitch information, and generates postfilter output code by passing synthesized signals outputted from synthesized signal generator 142 through the postfilter, and outputs the result (Step A6).

The operations of postfilter section 143 in this case include all of the operations of postfilter section 143 in the first embodiment with the exception of the operation of the pitch enhancement filter that enhances the pitch component. This operation is omitted because an operation equivalent to that of the pitch enhancement filter that enhances the pitch component has already been performed in prefilter section 146 at Step A12 shown in FIG. 6.

As one concrete example, the generation method used in the postfilter may take the form of a connection in series of, of the constituent elements of the postfilter in the first embodiment, the high-frequency enhancement filter that enhances the high-frequency component and the spectral shaping filter that enhances the spectral envelope.

The transfer function B(z) of the high-frequency enhancement filter in the second embodiment may be identical to the transfer function B(z) of the high-frequency enhancement filter in the first embodiment, and explanation is therefore here omitted. Moreover, the transfer function H(z) of the spectral shaping filter in the second embodiment may also be identical to the transfer function H(z) of the spectral shaping filter in the first embodiment, and explanation is therefore also here omitted.

During unvoiced sections, postfilter controller c144 activates postfilter state updater 144. Postfilter state updater 144 outputs without alteration background noise signals, which are the synthesized signals during unvoiced sections outputted from synthesized signal generator 142, and simultaneously updates the internal state of the filter of postfilter section 143 in accordance with the background noise signals. This process is executed in order to decrease any perception of noncontinuity in output signals occurring at switching between activation and deactivation of the postfilter at changes between voiced and unvoiced sections. In concrete terms, this involves updating the filter states of each of the filters of transfer functions B(z) and H(z) in the second embodiment. Moreover, the operation of updating the filter states of each of the filters is equivalent to the operation of setting the coefficient of each filter to 0 and allowing passage through each filter (Step A7).

The operation of postfilter state updater 144 in the second embodiment differs from the operations of the postfilter state updater 144 in the first embodiment in that the executed operations exclude that of updating the internal state of the pitch enhancement filter that enhances the pitch component. The operation of updating the internal state of the pitch enhancement filter that enhances the pitch component is excluded because this operation has already been carried out at prefilter state updater 147 in Step A13 in FIG. 6.

The operations of output signal interpolator 145, output signal controller c145, and output signal switch s145 in the second embodiment shown in Steps A8–A10 of FIG. 6 may be identical to the operations of the output signal interpolator 145, output signal controller c145, and output signal switch s145 of the first embodiment, and explanation of these operations is therefore here omitted.

In addition, modifications in which output signal interpolator 145, output signal controller c145, and output signal switch s145 are omitted from the first and second embodiments can also be considered in addition to the first and second embodiments.

As an additional modification to the first and second embodiments, a form that is a mathematically equivalent variation may also be considered.

As explained hereinabove, the speech decoding device according to the present invention does not activate a postfilter process requiring a massive amount of processing during unvoiced sections, and therefore provides the effect of enabling a large reduction in power consumption.

Moreover, even though a postfilter process is not activated during unvoiced sections, the updating process of the internal state of the postfilter is continued during these intervals, and as a result, no degradation occurs in the quality of synthesized speech signals even immediately after following changes from unvoiced to voiced sections.

Finally, at times of change between voiced and unvoiced sections, signals are outputted by interpolating between output signals produced through postfilter processing that are outputted during voiced sections and output signals for which postfilter processing is not executed that are outputted during unvoiced sections, and as a result, noncontinuity is not perceivable in the reproduced signals at changes between voiced and unvoiced sections.

It is to be understood, however, that although the characteristics and advantages of the present invention have been set forth in the foregoing description, the disclosure is illustrative only, and changes may be made in the arrangement of the parts within the scope of the appended claims.

What is claimed is:

1. A speech device receiving a coded speech signal and voiced/unvoiced information relating to said coded speech signal; said device comprising:

a background noise generator producing a background noise signal based on a preceding coded speech signal;

a first switch providing, as a first output signal, said coded speech signal when said voiced/unvoiced information indicates said coded speech signal is voiced, and said background noise signal when said voiced/unvoiced information indicates said coded speech signal is unvoiced;

a synthesized signal generator exciting said first output signal to provide an excited signal, and generating a sythesized signal based on said excited signal and on said first output signal;

a second switch providing said synthesized signal to a to a postfilter section when said voiced/unvoiced information indicates said coded speech signal is voiced, and to a postfilter state updating section when said voiced/unvoiced information indicates said coded speech signal is unvoiced;

said postfilter section performing filter processing based on said sythesized signal and on said first output signal and providing, as a second output signal, a postfiltered signal; and said postfilter state updating section updating an internal state of said postfilter section based on said sythensized signal and providing, as said second output signal;

wherein said postfilter section is not activated when said voiced/unvoiced information indicates said coded speech signal is unvoiced.

2. A speech decoding device that inputs both speech signals that are encoded to code including speech spectral envelope information, sound level, pitch information, and noise information; and information that distinguishes between voiced sections in which speech signals are present and unvoiced sections in which speech signals are absent; that decodes and outputs inputted speech signals during voiced sections; and that decodes and outputs background noise signals during unvoiced section that are generated and encoded based on speech signals inputted during an immediately preceding voiced section; and further comprising:

synthesized signal generating means that excites pitch information and noise information included in said speech signals and background noise signals, and generates sythesized signals based on these excited signals and speech spectral envelope information contained within said speech signals and background noise signals;

postfilter means that forms a postfilter based on speech spectral envelope information and pitch information contained within said speech signals and background noise signals, inputs synthesized signals generated by said synthesized signal generating means, performs filter processing, and outputs a result;

postfilter state updating means that passes sythesized signal generated by said synthesized signal generating means and updates the internal state of said postfilter based on said passed synthesized signal information; wherein said synthesized signal generated means is connected to said postfilter means and synthesized signals are outputted by way of said postfilter during said voice section; and said synthesized signal generating means is connected to said postfilter state updating means and synthesized signal are outputted by way of said postfilter state updating means during said unvoiced sections; and an output signal interpolating means that inputs and stores both signals outputted by said postfilter means and signals that have passed through said postfilter state updating means, and that outputs signals synthesized from said two types of signals; and which outputs synthesized signals that are outputted by said output signal interpolating means at changes between said voiced sections and unvoiced sections.

3. A speech decoding device that inputs both speech signals that are encoded to code including speech spectral envelope information, sound level, pitch information, and noise information; and information that distinguishes between voiced sections in which speech signals are present and unvoiced sections in which speech signals are absent; that decodes and outputs inputted speech signals during voiced sections; and that decodes and outputs background noise signals during unvoiced sections that are generated and encoded based on speech signals inputted during an immediately preceding voiced section; and further comprising:

signal exciting means that excites and outputs pitch information and noise information contained within said speech signals and background noise signals;

prefilter means that forms a prefilter based on pitch information contained within said speech signals and background noise signals, inputs excited signals outputted by said signal exciting means, performs filter processing, and outputs a result;

prefilter state updating means that passes excited signals outputted by said signal exciting means and updates the internal state of said prefilter based on said passed excited signal information;

synthesized signal generating means that is connected to said prefilter means and said prefilter state updating means and that generates synthesized signals based on inputted signals and speech spectral envelope information contained within said speech signals and background noise signals;

postfilter means that forms a postfilter based on speech spectral envelope information and pitch information contained within said speech signals and background noise signals, inputs synthesized signals generated by said synthesized signal generating means, performs filter processing, and outputs a result; and postfilter state updating means that passes synthesized signals generated by said synthesized signal generating means and updates the internal state of said postfilter based on said passed synthesized signal information; wherein during said voiced sections, signals outputted by said signal exciting means are inputted to said synthesized signal generating means by way of said prefilter means, and moreover, said synthesized signal generating means is connected to said postfilter means and synthesized signals are outputted by way of said postfilter; and during said unvoiced sections, signals outputted by said signal exciting means are inputted to said synthesized signal generating means by way of said prefilter state updating means, and moreover, said synthesized signal generating means is connected to said postfilter state updating means and synthesized signals are outputted by way of said postfilter state updating means.

4. A speech decoding device according to claim 3 which further comprises an output signal interpolating means that inputs and stores both signals outputted by said postfilter means and signals that have passed through said postfilter state updating means, and that outputs signals synthesized from said two types of signals; and which outputs synthesized signals that are outputted by said output signal interpolating means at changes between said voiced sections and unvoiced sections.

* * * * *